US005445892A

United States Patent [19]

Riedl et al.

[11] Patent Number: 5,445,892

[45] Date of Patent: Aug. 29, 1995

[54] OBJECT HAVING A ROSY PINK COLORING

[75] Inventors: Robert Riedl, Unterkulm; Jean-Paul Randin, Cortaillod, both of Switzerland

[73] Assignee: Eta SA Fabriques d'Esbauches, Granges, Switzerland

[21] Appl. No.: 164,542

[22] Filed: Dec. 10, 1993

[30] Foreign Application Priority Data

Dec. 23, 1992 [FR] France ..... 92 15816

[51] Int. Cl.[6] ..... B32B 15/04

[52] U.S. Cl. ..... 428/469; 428/472; 428/698; 428/699; 206/37; 206/524.2

[58] Field of Search ..... 428/469, 472, 698, 699; 420/555, 580, 587, 588; 106/286.2, 286.4, 286.5, 286.6; 206/37, 524.2

[56] References Cited

U.S. PATENT DOCUMENTS 4,745,035 5/1988 Saurer ..... 428/614
4,804,517 2/1989 Schaffer ..... 420/587
5,015,537 5/1991 Uchiyama ..... 428/698

FOREIGN PATENT DOCUMENTS 0322812 7/1989 European Pat. Off. .
3304598 8/1984 Germany .

*Primary Examiner*—Ellis P. Robinson
*Assistant Examiner*—Timothy M. Speer
*Attorney, Agent, or Firm*—Griffin, Butler, Whisenhunt & Kurtossy

[57] ABSTRACT

A rosy pink colored object has a first layer of nitride of an element chosen from the group comprising Ti, Zr, Hf, or a mixture of these elements. This first layer includes at least an element chosen amongst Al, C and elements of the groups Vb and VIb. A second layer comprises a mixture of palladium (Pd) and indium (In). Certain ternary metals such as Al or Cu may be added to the PdIn mixture. The covering may be used in jewelry, optometry or horology.

10 Claims, No Drawings

OBJECT HAVING A ROSY PINK COLORING

BACKGROUND OF THE INVENTION

The present invention concerns an object having a rosy pink colored covering on a substrat forming the body of the object, said covering comprising a first layer of nitride of an element chosen from the group comprising Ti, Zr, Hf, or a mixture of these elements, said first layer including at least an element chosen amongst Al, C and elements of the groups Vb and VIb.

A rosy pink colored covering has already been proposed in a single layer of nitride as defined above. In this regard, reference may be made to the document published in February 1991 by the-company Leybold AG (Germany) and titled: "What you ever wanted to know about deco coatings", Part III. A chapter of this publication is concerned with obtaining of the coloring called "rosy pink", this being a pink which has reddish tones and which is currently fashionable for covering the mountings of spectacles. Until now such a covering which is sufficiently hard so as to be resistant against wear and scratches has not been proposed, the alloys which have been proposed being relatively soft and comprising for example intermetalic compositions including essentially palladium and indium, the color of this composition varying from pale-yellow to the color gold or rose-gold. Such a composition, the hardness of which is hardly greater than 350 $HV_1$, is described in U.S. Pat. No. 4,804,517.

A color may be characterised by its shade, its clarity and its saturation. Apparatus, for example the colormeter Minolta CR200 and the spectrophotometer Perkin-Elmer 555 equipped with an integration sphere, convert all the colors within the range of human perception into a digital code which allows several people to express very accurately the color under discussion. This code is defined in a recommandation of the International Lighting Committee (CIE, 1976). This system espresses the color L* a* b*. When a color is expressed in this system, the clarity (luminance) is indicated by the value L* whilst the,shade and the saturation are expressed by a* and b*; a* and b* indicate two axes of color, i.e. a* the red-green axis and b* the yellow-blue axis. The positive values of a* correspond to red, negative to green, whilst the positive values of b* correspond to yellow and negative to blue. The value of the clarity (luminance) L* may vary between 0 (black) to 100 (white)

The publication of the Leybold company mentionned above defines the coloration "rosy pink" by the following values: L*=73, a*=8 and b* =5. In order to achieve this coloration, several compositions have been proposed which are all a hard layer (>600 HV1) of nitride applied to a substrate by physical vapor deposition (PVD), each of these layers only slightly approaching the definition of color indicated for rosy pink. These compositions are given hereafter with the corresponding coloration.

| | |
|---|---|
| $Ti_{90}Al_{10}N_x$ | L* = 57, a* = 9, b* = 5 |
| $Ti_{95}Al_5N_x$ | L* = 57, a* = 10, b* = 8 |
| $Ti_{80}Al_{10}V_{10}N_x$ | L* = 60, a* = 7, b* = 7 |
| $Zr_{80}Al_{20}N_x$ | L* = 53, a* = 6, b* = 6 |
| $Ti_{80}Cr_{20}N_x$ | L* = 63, a* = 4, b* = 9 |
| TiCxNy | L* = 61, a* = 7, b* = 5 |

SUMMARY OF THE INVENTION

To these compositions, the Applicant will add the following composition which it has successfully produced:

| | |
|---|---|
| $Zr_{80}Ti_{20}C_xN_{1-x}$ | L* = 62, a* = 7, b* = 7 |

If the nitride of titanium (TIN) is known for its yellow color, close to that of golds. The addition of aluminium, or chromium, or of carbon to this nitride causes the appearance of the tendancy towards red and finally a shade which is close to the desired rosy pink. However, it will be noted in all of the above-mentioned cases, that the clarity (luminance) L* is much too low, which leads to an unattractive dull color. Now, it has been noted that to make this coloration attractive a clarity (luminance) L* having at least a value of 70 is absolutely necessary.

To achieve this, the present invention envisages the application to the first layer of nitride of a second layer constituted by a mixture of palladium (Pd) and indium (In).

DETAILED DESCRIPTION OF PREFERRED EMBODIMENTS

The invention will now be explained in detail.

On the body of the object, which may be a spectacle mounting or a piece constituting a watch-case (carrure, lunette, fond, etc.) a rosy pink colored covering is deposited. This covering include a first layer of a nitride (N) of an element chosen from the group comprising Titanium (Ti), Zirconium (Zr) and Hafnium (Hf), or mixture of these elements, this first layer including at least an element chosen amongst aluminum (Al), carbon (C) and elements of the groups Vb and VIb. This layer will be deposited preferably by a PVD procedure and its thickness may vary between 0.1 and 2.5 μm. The choice of elements will be dictated by the color that one desires to obtain (see the table above). It will be noted that during the deposition, oxygen may be added, which further accentuates the reddish tendancy. The layer obtained is very hard, its hardness being greater than 600 $HV_1$, which makes the object resistant to wear and above all to scratches.

To this first layer, a second layer of a mixture constituted by palladium (Pd) and indium (In) is deposited. This second deposit aims to increase the clarity (luminance) L* as has been said previously and constitutes an increase in the accuracy of the shade a* and b* that may be obtained.

As has also been stated above, this second layer, whose thickness may be limited between 0.05 and 1 μm, is not particularly resistant to scratches. If this second layer was not preceded by the first, it would be necessary to increase its thickness, for example to greater than to 10 μm, to assure it of a reasonable lifetime. Nevertheless, it will be understood that a scratch in a thick layer is much more visible than in a thin layer where it will be not as deep. As a result, the scratches applied to the second thin layer of the invention are not very deep and thus less visible, since they are limited by the first layer of nitride, in principle unscratchable. As to normal wear, by rubbing for example, this is also less visible in the covering of the invention, because once the second layer has disappeared, the first layer remains, in principle unwearable, which has a color matched to that of the second.

Returning to the second layer of PdIn mentioned above, measurements have shown a coloration defined by $L^*=70$, $a^*=14$ and $b^*=3$ if the mixture has a stoichiometric composition, that is to say 48.3% in weight of Pd and 51,7% in weight of In.

To obtain a coloration approaching the desired rosy pink, a mixture is proposed consituted principally of palladium and indium, to which is added a ternary element chosen amongst Mg, Al, Si, Sn, Sb, Cu, Ag, Au, Zn, Y, Ti, Zr, Hf and Ni.

In particular, a mixture including 46 to 58% by weight of palladium, 42 to 54% by weight of indium and 0.5% to 5% by weight of aluminium provides satisfactory results More precisely, the mixture 47.49% by weight of Pd, 51.25% by weight of In and 1.26% by weight of Al gives an hardness of 284 $HV_1$ and a coloration $L^*=70$, $a^*=8$ and $b^*=5$ which is very close to the rosy pink coloration defined above ($L^*=73$, $a^*=8$, $b^*=5$).

Likewise, a mixture including 42 to 52% by weight of palladium, 42 to 54% by weight of indium an 0.5 to 6% by weight of copper also provides a satisfactory result. More precisely, the mixture 45.15% by weight of Pd, 52.52% by weight of In and 2.33% by weight of Cu gives a hardness of 242 $HV_1$ and a coloration $L^*=71$, $a^*=8$ and $b^*=4$, which is also close to the rosy pink coloration whose values are recalled in the preceding paragraph.

It should further be noted that a part from the sought after rosy pink coloration, the alloy PdIn, in particular in the intermetallic phase $\beta$-PdIn, can have a coloration close to that of gold which results in interest in its use for economical reasons, palladium, also classified as a precious metal, being several times less expensive than gold.

The second layer considered here has been deposited by a PVD process, as was the first layer. The principle is to bombard the surface of a target of material to be deposited with ions, in general $Ar+$, which have an energy sufficient to eject one or several atoms of the target; these atoms are thus projected towards the substrate where they are deposited in the form of the covering.

We claim:

1. An object having a rosy pink colored coating thereon, comprising:

(A) a substrate forming a body of the object;

(B) a first layer on the substrate, said first hard layer comprising, (a) a nitride of at least one of the elements selected from the group consisting of Ti, Zr, and Hf, and (b) at least one of the elements selected from the group consisting of Al, C, group Vb and VIb elements; and (C) a second layer on the first layer, said second layer comprising a mixture of palladium and indium wherein said object exhibits a clarity value of at least 70.

2. Object according to claim 1, wherein the mixture of palladium and indium is a stoichiometric composition thereof.

3. Object according to claim 2, wherein the substrate is a watch-case or at least a part constituting a watch-case.

4. Object according to claim 1, wherein said mixture is constituted principally of palladium and indium and at lease one of the elements Mg, Al, Si, Sn, Sb, Cu, Ag, Au, Zn, Y, Ti, Zr, Hf or Ni.

5. Object according to claim 4, wherein said mixture comprises 46 to 58% by weight of palladium, 42 to 54% by weight indium and 0.5 to 5% by weight of aluminum.

6. Object according to claim 5, wherein the substrate is a watch-case.

7. Object according to claim 3, wherein said mixture comprises 42 to 52% by weight of palladium, 42 to 54% by weight of indium and 0.5 to 6% by weight of copper.

8. Object according to claim 7, wherein the substrate is a watch-case.

9. Object according to claim 4, wherein the substrate is a watch-case.

10. Object according to claim 1, wherein the substrate is a watch-case or at least a part constituting a watch-case.

* * * * *